US005885060A

United States Patent [19]

Cunkelman et al.

[11] Patent Number: 5,885,060

[45] Date of Patent: Mar. 23, 1999

[54] THERMOSTATICALLY CONTROLLED INTERCOOLER SYSTEM FOR A MULTIPLE STAGE COMPRESSOR AND METHOD

[75] Inventors: Brian L. Cunkelman, Wilmerding; Walter E. Goettel, Monongahela; Daniel G. Wagner, Pittsburgh; Roger Drummond, Hermine, all of Pa.

[73] Assignee: Westinghouse Air Brake Company, Wilmerding, Pa.

[21] Appl. No.: 686,433

[22] Filed: Jul. 26, 1996

Related U.S. Application Data

[63] Continuation-in-part of Ser. No. 657,651, Jun. 3, 1996, abandoned.

[51] Int. Cl.[6] ..... F04B 25/00

[52] U.S. Cl. ..... 417/243

[58] Field of Search ..... 417/243, 228, 417/245, 258

[56] References Cited

U.S. PATENT DOCUMENTS 3,216,648 11/1965 Ford ..... 41/243 X 4,362,462 12/1982 Blotenberg ..... 417/243 X 5,106,270 4/1992 Goettel et al. ..... 417/243

5,195,874 3/1993 Odagiri ..... 417/243 X 5,674,053 10/1997 Paul et al. ..... 417/243 X

*Primary Examiner*—Ismael Izaguirre

*Attorney, Agent, or Firm*—James Ray & Associates

[57] ABSTRACT

A thermostatically controlled intercooler system for use with a multiple stage compressor to prevent the condensation of water from the compressed gas, such as air, within the system, whereby the temperature of a compressed gas entering a second compressor stage following the first compressor stage is controlled to a target temperature, ideally up to about 250° F., as will not allow the partial pressure of the water vapor therein to exceed the saturation vapor pressure associated with and defined by the temperature achieved by cooling the air prior to the air entering the subsequent compression stage.

10 Claims, 1 Drawing Sheet

THERMOSTATICALLY CONTROLLED INTERCOOLER SYSTEM FOR A MULTIPLE STAGE COMPRESSOR AND METHOD

CROSS-REFERENCE TO RELATED APPLICATIONS

This application is a Continuation-In-Part of patent application Ser. No. 08/657,651, filed Jun. 3, 1996, now abandoned.

FIELD OF THE INVENTION

The present invention relates, in general, to multiple stage compressors and, more particularly, this invention relates to a thermostatically controlled intercooler system for use with multiple stage compressors that functions to control the inlet temperature of the compressed gas at a second and/or subsequent compression stage to effectively prevent the condensation of water within the compressor. By permitting controlled, preselected amounts of uncooled compressed gas from one compressor stage to by-pass the in-line intercooler, the combined temperature of the compressed air emerging jointly from the intercooler and by-pass can be controlled to a predetermined value, selected to assure that the partial pressure of the water vapor therein does not exceed the saturation vapor pressure associated with and defined by that temperature and compression ratio of the previous compression stage.

BACKGROUND OF THE INVENTION

Mechanical, single stage, air compressors are well known in the art which comprise one of several different types, such as piston and cylinder type, centrifugal type, axial-flow type, turbine type and even other types. The simplest and most common type in use is the piston and cylinder type. In this type compressor air, or any gas, is admitted via a valve into the cylinder where a reciprocating piston therein compresses the air or gas within the cylinder and displaces the compressed air to a conduit or reservoir from which it can be taken for use as may be required.

Multiple stage air compressors are also well known in the prior art. Such multiple stage compressors are utilized to compress air and/or other gas to pressures which are higher than can normally be achieved with a single stage compressor. These multiple stage compressors normally comprise a plurality of mechanical single stage compressors of any one type or the other, interconnected in series, wherein the compressed gas is passed from one stage to the next with the pressure thereof being increased at each succeeding stage. In the typical multiple stage compressor of the piston and cylinder type, air or gas, at ambient pressure and temperature, is admitted into the cylinder of the first compressor stage where a first reciprocating piston serves to compress the air therein and displace it to the second stage and so on through all the stages in the system, with each stage further compressing the previously compressed gas until the final desired pressure is achieved.

It is also well known that most multistage compressors normally include a cooling step of the compressed air between at least some of the various compressor stages so that the overall compression may be more isothermal than adiabatic. That is to say, because of the ideal gas law, (PV=nRT), each compression stage of the air will, of course, cause an increase in pressure, P, as intended, and will also cause a directly proportional increase in the air temperature, T.

While this in not normally a problem in a typical single stage compressor, where a defined volume of air is compressed but once, the relatively high air pressures obtained in most multistage compressors can result in the compressed air having excessive and problematical temperatures, but for the intermediate cooling of the compressed air between the various compression stages.

For example, compressed air temperatures in excess of 500° F.(about 260° C.) is not only a hazard to persons therearound, but can cause operating difficulties of various different forms, such as malfunctioning valves and other compressor components. As a result, practically all commercially available multiple stage compressors include an intercooler system of some sort between at least some of the compression stages for the purpose of preventing excessive heating of the compressed gases compressed to such high pressure levels.

It is also well known that water exists as vapor in practically any ambient air to be compressed in a conventional compressor, which is quantified as the relative humidity of the air. The relative humidity of the air, expressed as a percent value, is the ratio of (a) the water vapor actually present in the air, in comparison to (b) the saturation vapor pressure at the temperature in question. The saturation vapor pressure is a function of the air temperature, so that as the temperature increases for any given sample of air, the saturation vapor pressure increases, and accordingly, the relative humidity decreases.

In a compressor, the above natural conditions can create a problem. Obviously, when the air is compressed, with little or no externally caused change in temperature, the temperature of the compressed air is increased in proportion to the increase in pressure, as noted above. Because the saturation vapor pressure of water is dependent on the temperature of the air, it follows that when the temperature is increased the saturation vapor pressure is also increased.

Thereafter, if the compressed air is cooled by any means, such as an intercooler, for example, it is not uncommon for the water vapor pressure in the twice-compressed air to actually exceed the saturation vapor pressure for the compressed air. This is, particularly, the case if the compressed air is allowed to further cool thereafter. Therefore, it is not uncommon for this phenomenon to cause significant amounts of water to be condensed as liquid within the system.

Free water within the compressor, however, is known to cause a variety of problems, such as oxidation (rusting) of compressor components, and more importantly, cause condensed water to be admixed into the lubricating oil within the compressor sump. Such dilution of the lubricating oil in the compressor with water can seriously impair the normal operation of the compressor as well as reduce its overall useful life. Therefore, it is highly desirable to eliminate, or to at least substantially minimize, the condensation of such water within any compressor, particularly any such water that may find its way into the lubricating oil.

SUMMARY OF THE INVENTION

This invention is predicated on our joint conception and development of a thermostatically controlled intercooler system for use with a multiple stage compressor, which can virtually prevent, or at least significantly minimize, the condensation of water from the compressed air within the system. In the thermostatically controlled intercooler system of this invention, the inlet temperatures of the compressed air at least at some of the compression stages following the first stage, is controlled to a value that will prevent the partial pressure of the water vapor in the compressed air from exceeding the saturation vapor pressure at the pressure and temperature achieved by the previous compression stage, to virtually prevent, or at least greatly minimize, condensation of water within the compressor. Such a temperature control is effected by permitting controlled, preselected amounts of uncooled compressed air from the previous compressor stages to by-pass the next, in-line intercooler, and be blended with the cooled, compressed air emerging from the intercooler. Such blending of cooled and uncooled compressed air will permit control of the temperature of the compressed air entering the next following compression stage, and with attention to such temperature control it is possible to select and control the temperature of that compressed air to a value that will not be increased upon further compression to a level that will exceed the normal safe operating temperature for an air compressor.

OBJECTS OF THE INVENTION

Accordingly, it is one of the primary objects of this invention to provide a new and improved multiple stage gas compressor having a significantly reduced tendency for water condensation therein.

Another object of the present invention is to provide a new and improved thermostatically controlled intercooler system for use with a multiple stage compressor that significantly reduces the tendency for water condensation within the multiple stage compressor.

A further object of the present invention is to provide a new and improved thermostatically controlled intercooler system for use with a multiple stage compressor that controls the inlet temperature of the compressed air at a second and/or subsequent compression stage to thereby substantially eliminate the condensation of water within the compressor.

Still another object of the present invention is to provide a new and improved thermostatically controlled intercooler system for use with a multiple stage compressor that controls the inlet temperature of the compressed air at a second and/or subsequent compression stage by permitting controlled amounts of uncooled, compressed air to by-pass the intercooler, thereby raising the temperature of the inlet compressed gas entering the next compressor stage so that its temperature can be controlled to a level that will prevent the partial pressure of water therein saturation vapor pressure of the compressed gas from being reduced to a level below the partial pressure of water vapor therein, to thereby prevent or minimize water condensation within the compressor.

These and other objects and advantages of the present invention will become more readily apparent to those persons skilled in the compressor art after a full reading of the following detailed description, particularly, when such description is taken in conjunction with the attached drawings as described below.

DESCRIPTION OF THE PREFERRED EMBODIMENT OF THE INVENTION

Figure 1:
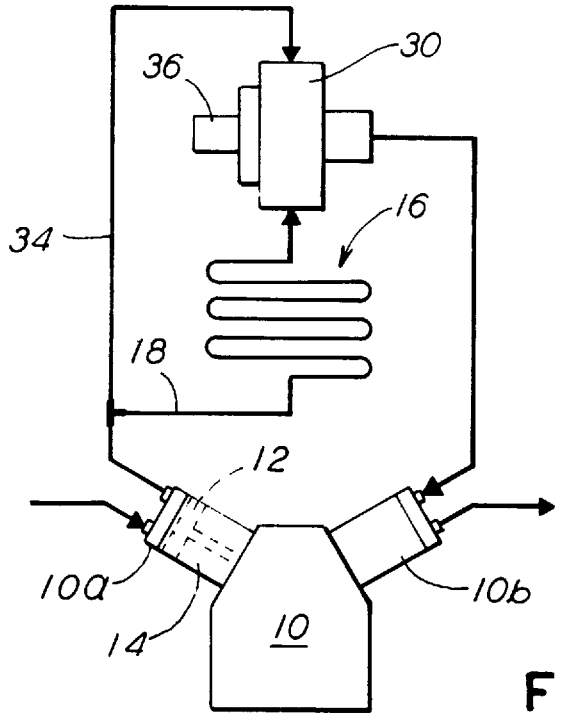
FIG. 1 is a simplified, schematic view of a two-stage gas compressor incorporating a thermostatically controlled intercooler system according to a presently preferred embodiment of this invention.

Prior to proceeding with a detailed description of the subject invention, it is noted that for the sake of clarity, identical components which have identical functions have been identified with identical reference numerals throughout the several views of the attached drawings.

Figure 2:
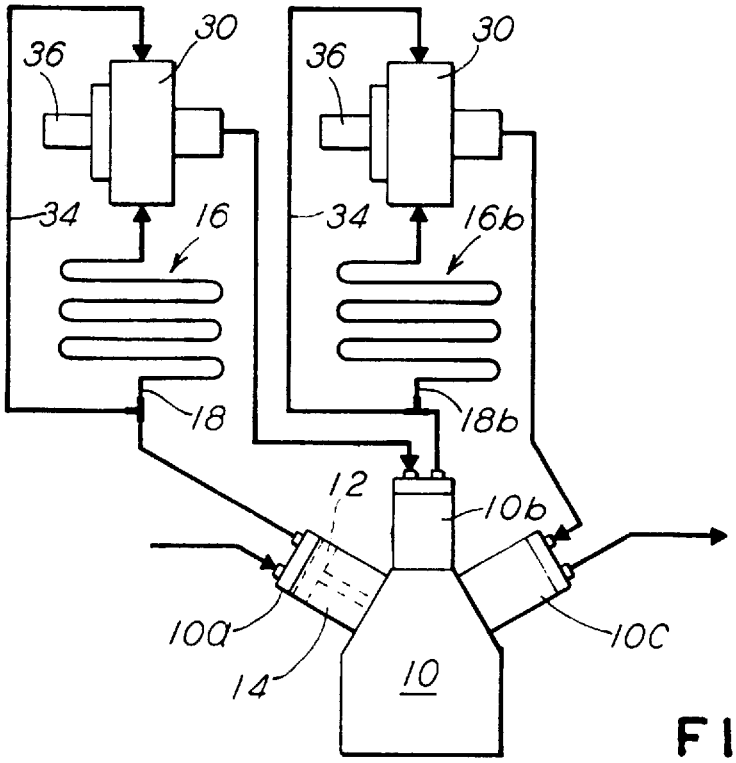
FIG. 2 is a simplified, schematic view of a three-stage gas compressor incorporating a thermostatically controlled intercooler system according to another presently preferred embodiment of this invention.

Reference to FIGS. 1 and 2 will illustrate in schematic form two presently preferred embodiments of this invention, namely, FIG. 1 being a multiple stage compressor having two compressor stages with a single intercooler therebetween, and FIG. 2 being a multiple stage compressor showing the first three compressor stages in a system having a plurality of compressor stages, with an intercooler between at least the second and third compressor stages and between the third and any subsequent compressor stages.

In each of the figures, the multiple stage compressors, generally designated 10, include a first compressor stage 10*a*, which is schematically illustrated as a piston and cylinder type of compressor having a piston 12 mounted for reciprocal movement within a cylinder 14.

While such piston and cylinder type of compressors are perhaps the most common, it should be appreciated that this invention can be incorporated into multiple stage compressors based on other forms of mechanical compressors, such as a centrifugal type, an axial-flow type, a turbine type and other types, particularly any such multiple stage compressor wherein an intercooler is provided between any two compressor stages for the purpose of preventing the compressed gas from becoming excessively heated.

As is well known, piston and cylinder type mechanical compressors are provided with a suitable valve arrangement (not shown) which are closed during a compression stroke to permit the gas therein to be suitably compressed, with an outlet valve (not shown) opening thereafter, permitting the compressed gas to be directed out of the cylinder 14 and into a discharge line 18. Thereafter, the outlet valve is closed as an inlet valve (not shown) is opened so that the reciprocating piston 12 will draw in fresh gas at ambient pressure to repeat the compression process. Such valving arrangement is well know to those familiar with the art and need not be further described here.

As in some two-stage compressors, an intercooler 16 is provided which is adapted to cool the gas compressed after a compressor stage, such as a first compressor stage 10*a*, before it is further compressed and heated in the next following compressor stage, i.e., compressor stage 10*b*. Accordingly, such discharge line 18 is provided which is adapted to convey the gas compressed in compressor stage 10A into the intercooler 16 so that the gas heated in compression stage 10*a* by virtue of its compression can be cooled, at least to some degree, before it is further compressed in compressor stage 10*b*.

As with other elements of the compressor described above, the intercooler 16 is also well known to those familiar with the compressor art. Such intercooler 16, normally, comprises a radiator-type of cooler wherein the heated gas is passed through a plurality of thin radiator tubes 20 spaced by cooling fins (not shown). Therefore, such intercoolers 16 need not be further described here in detail.

As shown in FIG. 2, the multiple stage compressor 10 may comprise more than two compression stages, such as three compression stages 10*a*, 10*b* and 10*c*, as shown in FIG. 2, or even more, with an intercooler 16 operably disposed between any pair of adjacent compression stages 10.

However, since excessive heating of the compressed gas is not normally a problem until a third or later compression stage is involved, some commercially available multiple stage compressors may only utilize an intercooler before the third and any subsequent compression stages.

In a like manner, as shown in the FIG. 1 embodiment, an intercooler 16 is provided, in the embodiment of FIG. 2, which is adapted to cool the gas compressed in compressor stage 10*a* before it is further compressed and heated in the second compressor stage 10*b*. Again, a discharge line 18 is provided which is adapted to convey the gas compressed in the first compressor stage 10*a* into the intercooler 16, so that the gas heated in compression stage 10*a* by virtue of its compression, can be cooled, at least to some degree, before it is further compressed in compressor stage 10*b*.

In a similar manner to that described above, another intercooler 16*b* is provided which is adapted to cool the gas compressed in the second compressor stage 10*b* before it is further compressed and heated in compressor stage 10*c*. Again, a discharge line 18*b* is provided which is adapted to convey the gas compressed in compressor stage 10*b* into the intercooler 16*b* so that the gas heated in compression stage 10*b* by virtue of its compression can be cooled, at least to some degree, before it is further compressed in compressor stage 10*c*.

In a like manner, additional intercoolers 16 are commonly operably disposed between any pair of subsequent compressor stages 10 for the purpose of cooling the previously compressed gas before it is further compressed, and accordingly further heated in such following compression stage. The operation of the systems described above are conventional in the prior art and need not be further described here.

The crux of this invention resides in a selective by-pass system, incorporated with the intercoolers 16, which permits control of the compressed gas temperature admitted into any selected compressor stage after the first compressor stage so that such inlet temperature can be deliberately controlled and maintained at a predetermined level which will assure that prior to inlet into the next compression stage, the gas temperature will not reduce to a level whereby the associated saturation vapor pressure has been reduced to a value below the partial pressure of water vapor at the intercooler pressure.

Accordingly, with reference to FIG. 1, the inventive elements include a three-way valve 30 adapted to receive compressed gas cooled by the associated intercooler 16 and direct the compressed gas to the subsequent compressor stage 10*b* for further compression. In addition, a by-pass line 34 is also provided which interconnects the associated compressor stage 10a directly with the three-way valve 30. Accordingly, the by-pass line 34 is adapted to pass compressed gas directly from the associated compressor stage 10*a* to the three-way valve 30 without such compressed gas passing through the intercooler 16. Therefore, the three-way valve 30 is adapted to selectively convey either cooled or uncooled compressed gas, or a controlled mixture thereof, onto the next succeeding compressor stage 10*b*.

In addition to the three-way valve 30 and by-pass line 34, the inventive elements of this invention further includes a control means 36 for controlling the operation of such three-way valve 30. Obviously, control means 36 should be a control adapted to selectively pass either cooled or uncooled compressed gas, or mixtures thereof, as necessary to maintain a preselected target temperature of the compressed gas entering into the compression stage 10*b*.

The preselected target temperature, will of course vary from one system to the next, but as noted above, it should be a temperature which is determined to be one that will prevent the gas from cooling to a point where the associated saturation vapor pressure of the gas does not fall to a value below the partial pressure of the water vapor in the gas mixture at the point prior to the inlet for the next compression stage.

While the above description is addressed primarily to the thermostatically controlled intercooler system between the first and second compression stages of the multiple stage compressor shown in FIG. 1, it should be readily apparent that any thermostatically controlled intercooler system should be substantially the same regardless of its location with respect to various compressor stages. The only differences in essence will be the target temperatures sought.

While a number of differing control means could be provided, and are within the scope of the present invention, we have preferred to use an "off-the-shelf" three-way type valve having a built-in temperature controlled valve operation. Specifically, we have successfully used both a 1.5-inch and a 2-inch three-way valve manufactured by FLUID POWER ENERGY having the built-in, out-put temperature controller, whereby the desired out-put temperature can be selected and set on the valve, with the valve then automatically out-putting a mixture of the two in-put gasses as necessary to provide an out-put blend thereof matching the preselected temperature. Since such valves are commercially available, it is believed that any further description and discussion thereof is not necessary here.

It may be apparent to those skilled in the art that exacting controls are not in fact necessary. For a conventional two-stage compressor utilizing two compression cylinders in the first stage and one compression cylinder for the second stage, with an intercooler between the first stage and the second, we have determined that water condensation can be significantly reduced, normal reliability levels and service life of the compressor can be expected if the ultimate temperature of the compressed gas, after compression in the second stage, remains below about 500° F. In the above noted system, we have learned that such a goal can be achieved by controlling the compressed gas temperature entering the second stage at a level of generally no more than about 250° F.(about 260° C.).

Furthermore, in order to prevent the condensation of water due to excessive cooling of the air at the intercooler pressure for a compression ratio of about 4:1 per compression stage and design inlet conditions for the preliminary compression stage set at about 150° F.(about 60.5° C.) and 100% relative humidity, a controlled output temperature at or above about 213.4° F. is necessary. Thus, both objectives can be accomplished by controlling the output air between about 213.4° F. and about 250° F.

Therefore, if the temperature of the compressed air exiting the first stage is at or below about 250° F.(about 120° C.), then all of that compressed air can be passed directly to the second stage without any of it having to be diverted through the intercooler. Only when the temperature of the compressed air emerging from any compressor stage is in excess of about 250° F.(about 120° C.), will it be necessary to divert a portion thereof through the following intercooler. By utilizing the temperature controlled three-way valve described above, the valve will itself adjust the temperature of the out-put.

Further testing of the above described apparatus having a thermostatically controlled intercooler, as described herein, in contrast to a prior art compressor being identical in all other respects except for the absence of the inventive control, has shown that the prior art compressor has routinely caused water build-up in the lubricating oil in amounts exceeding 1.0 percent, and even 2.0 percent water after operating for a defined test period of time.

An identical compressor having the thermostatic control of this invention, has managed to keep such water build-up in the lubricating oil at amounts consistently below about 0.1 percent, when operating the controls as necessary only to keep the temperature of the compressed gas entering the second compressor stage, preferably, at or below about 200° F.

Having described in detail a presently preferred embodiment of this invention, it should be apparent that various other embodiments could be utilized and modifications incorporated therein by those persons who are skilled in the compressor art without departing from either the spirit of the invention or the scope of the appended claims.

We claim:

1. A multiple stage gas compressor which will significantly minimize condensation of water therein, said multiple stage gas compressor comprising:

(a) at least two compressor stages interconnected in series for compressing a gas;

(b) at least one intercooler adapted to cool a gas compressed in a first compressor stage prior to its further compression in a second compressor stage;

(c) a discharge line interconnecting said first compressor stage with said intercooler adapted to pass compressed gas compressed in said first compressor stage into said intercooler;

(d) a three-way valve adapted to receive compressed gas cooled by said intercooler and direct such compressed gas to said second compressor stage;

(e) a by-pass line interconnecting said first compressor stage directly with said three-way valve and adapted to pass compressed gas directly from said first compressor stage to said three-way valve without such gas passing through said intercooler; and (f) control means for controlling said three-way valve such that compressed gas emerging therefrom and directed to said second compressor stage comprises one of cooled, compressed gas from said intercooler, uncooled compressed gas from said by-pass line, and a mixture of said cooled and uncooled compressed gases, as necessary to effect a preselected target temperature of such compressed gases directed by said three-way valve to said second compressor stage.

2. A multiple stage gas compressor, according to claim 1, wherein said compressor includes at least three compressor stages with said intercooler operably disposed between a second compressor stage and a third compressor stage with said three-way valve, said by-pass line and said control means associated with said intercooler.

3. A multiple stage gas compressor, according to claim 1, wherein said target temperature is generally between about 150° F. and about 250° F.

4. A multiple stage gas compressor, according to claim 1, wherein said three-way valve is of a type having a temperature control means built therein which enables presetting an output gas temperature.

5. A multiple stage gas compressor, according to claim 1, wherein said means for controlling said three-way valve is adapted to prevent a final temperature of said compressed gas compressed in said second compressor stage from exceeding generally about 500° F.

6. A thermostatically controlled intercooler system for a multistage gas compressor having at least two compressor stages interconnected in series and an intercooler for cooling a compressed gas emerging from a first compressor stage before it is compressed in a second compressor stage, said thermostatically controlled intercooler system comprising:

(a) a discharge line interconnecting said first compressor stage with said intercooler and adapted to pass compressed gas from said first compressor stage into said intercooler;

(b) a three-way valve adapted to receive compressed gas cooled by said intercooler and direct said compressed gas to said second compressor stage;

(c) a by-pass line interconnecting said first compressor stage directly with said three-way valve adapted to pass said compressed gas directly from said first compressor stage to said three-way valve without said compressed gas passing through said intercooler; and (d) means for controlling said three-way valve such that said compressed gas emerging therefrom and directed to said second compressor stage includes one of cooled, compressed gas from said intercooler, uncooled compressed gas from said by-pass line, and a mixture of said cooled and said uncooled compressed gases, as necessary to effect a preselected target temperature of said compressed gases directed by said three-way valve to said second compressor stage.

7. A thermostatically controlled intercooler system, according to claim 6, further having at least three compressor stages with an intercooler operably disposed between a second compressor stage and a third compressor stage with said three-way valve, said by-pass line and said control means associated with said intercooler.

8. A thermostatically controlled intercooler system, according to claim 6 wherein said target temperature is generally between about 150° F. and about 250° F.

9. A thermostatically controlled intercooler system, according to claim 6, wherein said three-way valve is of a type having a temperature control means built therein for presetting an-output gas temperature.

10. A thermostatically controlled intercooler system, according to claim 6, wherein said means for controlling said three-way valve is adapted to prevent a final temperature of said compressed gas compressed in said second compressor stage from exceeding generally about 500° F.

* * * * *